US006834780B2

(12) United States Patent
Levy

(10) Patent No.: US 6,834,780 B2
(45) Date of Patent: Dec. 28, 2004

(54) PASTE DISPENSER

(76) Inventor: Eli Levy, Kibbutz Tlalim, Mobile Post Halutza (IL), 85545

( * ) Notice: Subject to any disclaimer, the term of this patent is extended or adjusted under 35 U.S.C. 154(b) by 186 days.

(21) Appl. No.: 10/187,435

(22) Filed: Jul. 2, 2002

(65) Prior Publication Data

US 2003/0178441 A1 Sep. 25, 2003

(30) Foreign Application Priority Data

Mar. 21, 2002 (IL) ..... 148821

(51) Int. Cl.[7] ..... G01F 11/00

(52) U.S. Cl. ..... 222/260; 222/387; 222/517; 141/357

(58) Field of Search ..... 222/209, 260, 222/387, 505, 517; 141/357, 360, 362

(56) References Cited

U.S. PATENT DOCUMENTS

| | | | |
|---|---|---|---|
| 3,088,636 | A | 5/1963 | Spatz |
| 3,268,123 | A | 8/1966 | Spatz |
| 4,691,847 | A | 9/1987 | Ford et al. |
| 4,776,496 | A | 10/1988 | Battegazzore |
| 4,936,493 | A | 6/1990 | Foster et al. |
| 4,962,851 | A | 10/1990 | Schuckmann et al. |
| 4,978,037 | A | 12/1990 | Schuckmann |
| 4,991,744 | A | 2/1991 | Von Schuckmann |
| 5,975,362 | A | 11/1999 | West |
| 6,047,862 | A | 4/2000 | Davies |

FOREIGN PATENT DOCUMENTS

| | | | |
|---|---|---|---|
| DE | 34 17 312 | A1 | 11/1985 |
| DE | 198 08 864 | A1 | 10/1998 |
| GB | 2 150 105 | A | 6/1985 |
| GB | 2161222 | A | 1/1988 |

*Primary Examiner*—Philippe Derakshani
(74) *Attorney, Agent, or Firm*—Browdy and Neimark, P.L.L.C.

(57) ABSTRACT

An improved dispenser for pastes is disclosed comprising a variable volume paste chamber, a dispenser nozzle communicating with the chamber for dispensing paste, a displaceable element displaced by room pressure, as a result of a reduced pressure in the paste chamber, an actuating member, accessible from outside the container and displaceable from an inactive to an active position, an elastic element, a means for applying a force to the elastic element in such a way as to reduce the volume of the chamber, thereby causing said paste to be dispensed through said dispenser nozzle, when said actuating member is displaced from the inactive to the active position, a kinematism for kinematically connecting the actuating member to the means for applying a force to the elastic element when the actuating member is displaced to its active position, and for allowing the elastic element elastically to return to its base configuration when the actuating member is returned to its inactive position, and a support means for holding the paste container in a predetermined position when a force is applied to the elastic element.

31 Claims, 15 Drawing Sheets

A–A

PASTE DISPENSER

FIELD OF THE INVENTION

The present invention relates to the field of dispensers. More particularly, the invention relates to a paste dispenser, wherein a dispenser head may be actuated and paste may be dispensed in metered fashion with the use of only one hand. A rigid container for the paste is employed within which a unit is displaceable based on a pressure differential between the interior and exterior of a pumping chamber.

BACKGROUND OF THE INVENTION

Toothpaste is a well known dentifrice that effectively prevents tooth decay. Toothpaste is generally contained in a collapsible tube and is applied to a toothbrush to facilitate the cleaning of teeth. Several drawbacks are associated with the usage of a conventional tube for the dispensing of toothpaste therefrom. Since toothpaste is dispensed by squeezing the tube, a significant amount of toothpaste remains in the tube due to the inability of deforming the tube to such an extent so as to allow for the removal of the entire amount of the semi-fluid material. Also, an uncontrollable amount of toothpaste may be applied to a toothbrush, often resulting in unnecessary waste. At times, the cap of the toothpaste tube is misplaced and a significant amount of toothpaste is liable to dry, proximate to the aperture through which the toothpaste is released. Furthermore, the application of toothpaste to a toothbrush is an awkward procedure, in which two hands are generally needed for accurate and speedy dispensing.

Numerous prior art toothpaste dispensers, which overcome some of the aforementioned drawbacks, are known. For example, GB 2150105 discloses a dispenser that incorporates a means for mounting and moving a collapsible container relative to an evacuating means. Upon insertion of a toothbrush into a recess, a closure arm bears against an dispenser head lever, thereby moving the container a predetermined distance by the interengagement of a pinion and rack. DE 19808864 discloses an apparatus that includes a slide which is horizontally displaced upon insertion of a toothbrush, whereby a protrusion carried by the slide engages another member which uncovers the aperture through which toothpaste is dispensed. The slide is also provided with teeth which are engageable with a ratchet-toothed gear, the rotation of which causes rollers to squeeze a toothpaste tube. DE 3417312 is directed to a metering device which comprises a stationary housing part and a movable housing part. By pivoting the movable housing part relative to the stationary housing part, an actuating element is pressurized so that the required quantity of the substance to be metered is dispensed. U.S. Pat. No. 5,975,362 discloses a dispenser which comprises a rotatable power source for rotating a pair of pinch rollers, which move along a toothpaste tube to collapse a portion of the tube to thereby dispense toothpaste. All of these references are characterized by having a relatively large number of moving parts, resulting in a higher cost and a higher chance of malfunction.

U.S. Pat. No. 3,088,636 discloses a dispenser for a fluent mass, which is discharged therefrom as the effective volume of the container forwardly of a piston means is decreased, after which the volume is increased to create a partial vacuum, thereby allowing atmospheric pressure rearwardly of the piston means to act thereon and to move it forwardly in the container, so that the effective volume of the container is again decreased.

U.S. Pat. No. 3,268,123 provides a similar dispenser, without application of pressure to the fluent mass during the initial phase of decreasing the effective volume forward of the piston means. The device comprises means for resisting movement of the piston means in a rearward direction while permitting its movement in a forward direction within the container. Similar arrangements are taught in e.g. U.S. Pat. Nos. 4,978,037, 4,991,744 and 6,047,862.

Dispensers having a flexible membrane, which is flexed by means of a dispenser head following the depressing thereof, so that the membrane is longitudinally displaced in a rearward direction to allow for the decreasing of the effective volume of the container, are taught in e.g. U.S. Pat. No. 4,691,847, GB 2,161,222, U.S. Pat. No. 4,776,496, U.S. Pat. Nos. 4,936,493, 4,962,851. Paste is dispensed from the dispensers of the aforementioned citations with the use of two hands, and is at times an awkward procedure.

FIG. 1 schematically illustrates a toothpaste dispenser described in U.S. Pat. No. 6,047,862. In FIG. 1 said dispenser is generally designated by 5 and is provided with reservoir 2, pump head 3 and dispensing orifice 7. Closure 8 generally covers nozzle 7, and is separated therefrom during the dispensing of toothpaste. Reservoir 2 is cylindrical and contains toothpaste within pumping chamber 6, defined by the region between pressurizing means 9 and a follower piston, generally designated by 15. Distal end 10 of the dispenser which may have a larger outer diameter than container 2, is adapted to admit air to the distal end of unit 15. Toothpaste does not come in contact with air, and therefore cannot dry.

An exploded drawing of an exemplary incrementally displaceable unit 15 is shown in FIG. 2. Unit 15 comprises three elements: piston 18, clamp module 27 and disc 32. Piston 18 is described in detail in U.S. Pat. No. 4,978,037, and is provided with a plurality of circumferential fields 19 and 20, wherein each adjacent field is separated by a radially oriented groove 22 and 23, respectively. Each field 20 is disposed closer to the outer wall of centrally disposed seat 13 than a corresponding field 19. The piston is provided with distal lip 25 and proximate lip 26. Lips 25 and 26 have an outer diameter substantially equal to the inner wall of a tubular paste container and serve as a seal.

By means of clamp module 27, unit 15 is displaceable in only one direction, i.e. towards dispenser head 3, after dispenser 5 has been loaded with toothpaste. Clamp module 27 is shaped in the form of a star, with radially oriented prongs 29 interspersed between circumferential spacers 30, and is made of spring steel. The center of clamp module 27 is formed with aperture 31 having a diameter substantially equal to the outer wall of seat 13. Aperture 31 allows the clamp module to be pressed fit with diaphragm 18, such that each spacer 30 contacts distal lip distal lip 25. The diameter spanned by the ends of prongs 29 is slightly larger than the inner wall of container 2, and since the prongs are angled in a direction away from distal lip 25, displacement of unit 15 in a direction away from dispenser head 3 is prevented.

Disc 32 is the means by which unit 15 is displaced, as will be described hereinafter. Disc 32 is planar and circular, and is provided with peg 34 protruding from the proximate side thereof. Peg 34 is insertable within seat 13, so that disc 32 is carried by piston 18 as the latter is displaced.

All the methods described above have not yet provided satisfactory solutions to the problem of providing an inexpensive toothpaste dispenser with a minimal number of moving parts, which can apply toothpaste to a toothbrush by the use of only one hand and capable of dispensing a metered amount of toothpaste.

It is an object of the present invention to provide a toothpaste dispenser which can apply toothpaste to a toothbrush by the use of only one hand.

It is an additional object of the present invention to provide a toothpaste dispenser which is capable of dispensing a metered amount of toothpaste.

It is an additional object of the present invention to provide a toothpaste dispenser which is inexpensive with a minimal number of moving parts.

It is a further object of the present invention to provide a toothpaste dispenser wherein the toothpaste cannot dry.

Other objects and advantages of the invention will become apparent as the description proceeds.

SUMMARY OF THE INVENTION

The present invention relates to an improved dispenser for pastes comprising:

a) a paste container having a wall, b) an elastic means having a base configuration, being deformable by application of a force thereto and elastically returning to said base configuration when said application of a force is discontinued, c) a displaceable element, d) said wall, elastic means and displaceable element defining a variable volume paste chamber, e) a dispenser nozzle communicating with said chamber for dispensing paste therefrom, f) said displaceable element being displaced by room pressure, as a result of a reduced pressure in said paste chamber, towards said elastic means upon the return of said elastic means to said base configuration, g) an actuating member, accessible from outside the container and displaceable from an inactive to an active position, h) means for applying a force to said elastic means to deform said elastic means, in such a way as to reduce the volume of said chamber, thereby causing said paste to be dispensed through said dispenser nozzle, when said actuating member is displaced from the inactive to the active position, and i) a kinematism for kinematically connecting said actuating member to said means for applying a force to said elastic means to deform said elastic means, when said actuating means is displaced to its active position, and for allowing said elastic means elastically to return to said base configuration thereof when said actuating means is returned to its inactive position.

Preferably:

1) the wall of the paste container is tubular and the elastic means and the displaceable element are located at its opposite ends;

2) the actuating means comprise a swinging member that can be manually swung from the inactive to the active position by applying a force to it, more preferably through a toothbrush, and is provided with spring means to return it to the inactive position when the force is no longer applied to it;

3) the dispenser nozzle is normally in an inoperative position in which it does not communicate with the paste chamber and is displaceable, upon actuation of the actuating means, to an operative position in which it communicates with the paste chamber to allow dispensation of the paste therefrom;

4) the dispenser nozzle is operatively connected to the actuating means and to the elastic means and is a part of the said kinematism, whereby it is displaced to its operative position concurrently with the application of a force to the said elastic means.

5) a housing, more preferably a rigid, fixed housing, is provided for reciving and supporting a paste dispenser at a time, each paste dispenser being more preferably engageable with said housing, e.g. by means of projections engaging recesses provided in said housing, and protruding therefrom as far as necessary for the actuating means to be operated and for the paste to be received from the dispensing nozzle;

6) the displaceable element is a piston.

The displaceable element actually becomes displaced by increments, corresponding to the amount of paste discharged each time, though it has no such mechanical limitation, and because of this can be said to be incrementally displaceable.

As referred to herein, the "proximate" part of the dispenser is the one close to the dispenser head from which the paste is dispensed and the "distal" part is the one distant from the dispenser head. In use, the proximate part is generally the lower one and the distal part is the upper one. "Inwards" means in a direction towards the interior of the container, "outwards" means in a direction towards the exterior of the container, "longitudinal" is in a direction parallel to the length of the container, and "lateral" is in a direction perpendicular to a longitudinal direction.

In an embodiment, the container is permanently attached to the housing. In another embodiment, the container is releasably attachable to the housing.

The container is preferably attached to the housing by means of protrusions formed on the at least one outer wall of the container, said protrusions being insertable within similarly shaped tracks formed within the housing. Preferably, the protrusions extend longitudinally downwards along the container. Alternatively, the container can be attached to the housing by means of threading.

The housing is preferably provided with an air inlet, the incrementally displaceable unit being displaceable in a proximate direction due to a pressure differential between the interior and exterior of the pumping chamber of the dispenser, the pumping chamber achieving a partial vacuum upon discharge of paste from the pump chamber.

BRIEF DESCRIPTION OF THE DRAWINGS

In the drawings:

FIGS. 15 depicts different alternatives for limiting a downward movement of container, wherein

DETAILED DESCRIPTION OF PREFERRED EMBODIMENTS

FIGS. 3–10 illustrate one preferred embodiment of a dispenser according to the present invention, wherein a dispenser head is pivotable by an actuating means upon insertion of a toothbrush within an opening formed within the housing 110 of the dispenser.

Figure 1:
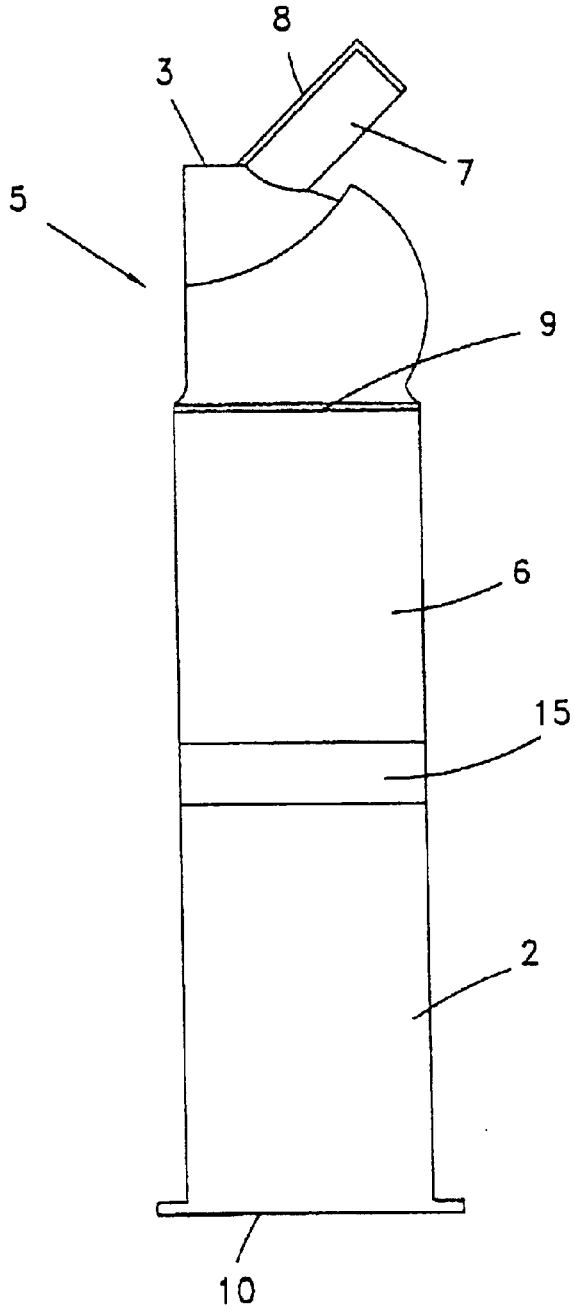
Fig. 1 (PRIOR ART)
FIG. 1 is a schematic drawing of a toothpaste container according to the prior art.
Figure 2:
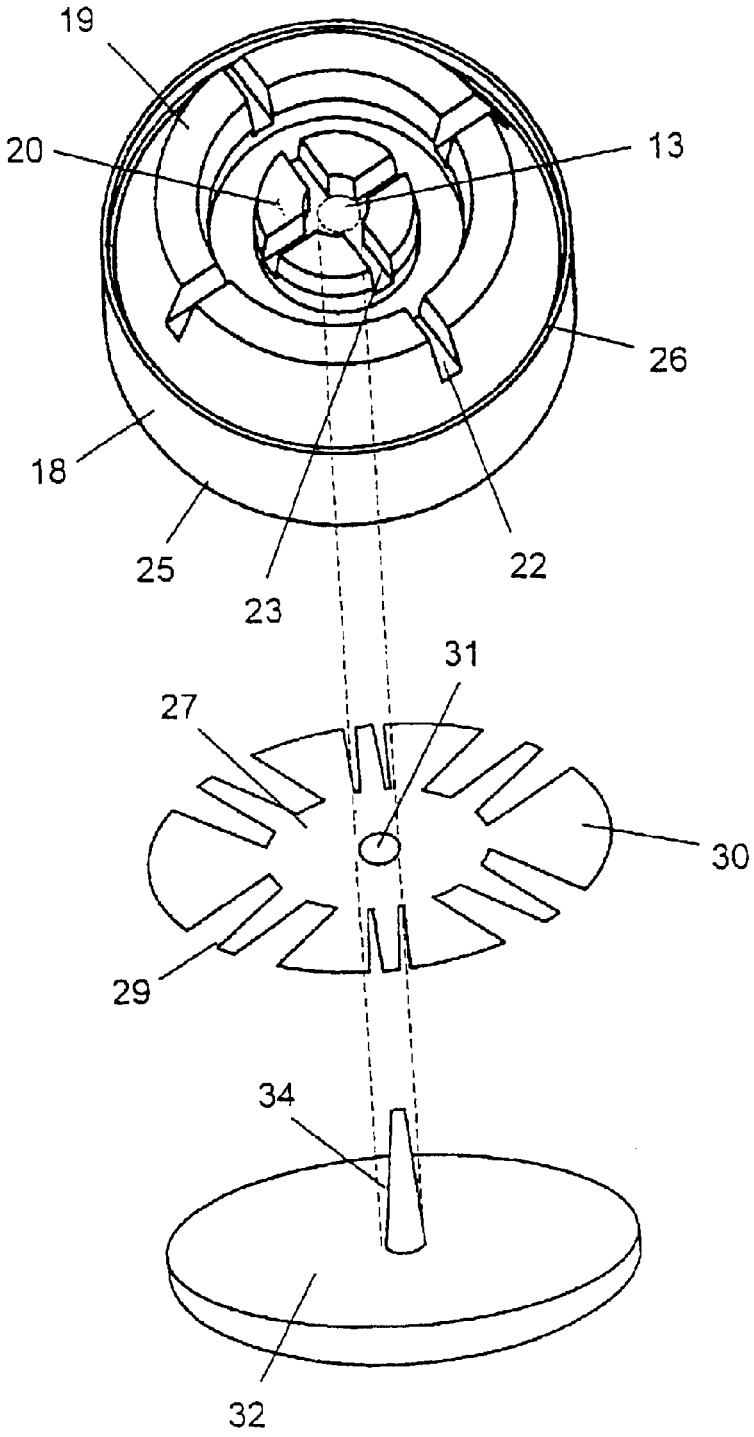
Fig. 2 (PRIOR ART)
FIG. 2 is an exploded drawing of an incrementally displaceable unit according to the prior art.
Figure 3:
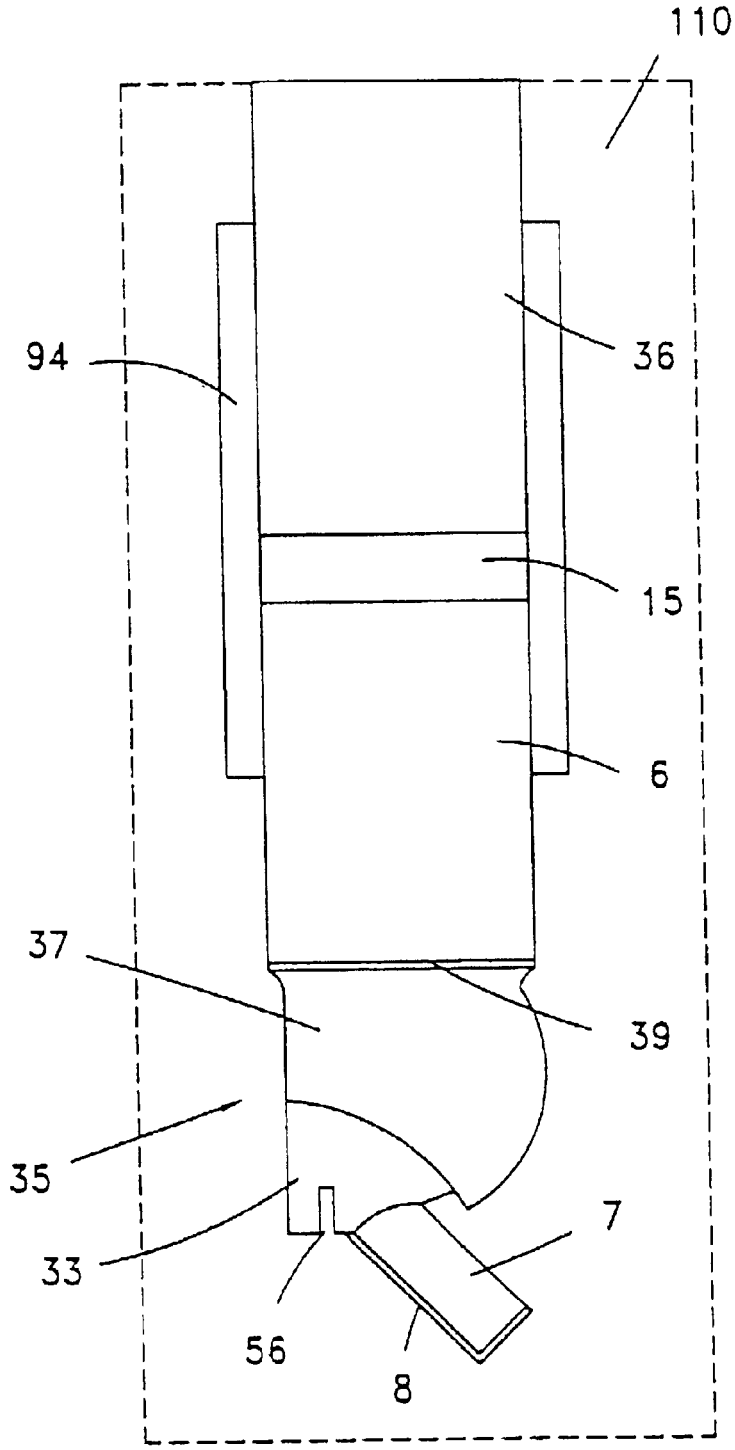
FIG. 3 is a schematic drawing of a toothpaste container, in accordance with one preferred embodiment of the present invention.

FIG. 3 illustrates a schematic drawing of a container, generally designated as 35, which is housed, and fixedly attached in this embodiment, to stationary housing 110. The container 35 is placed upside down, viz. in such a position that the paste is dispensed from its bottom. Container 35 comprises rigid outer wall 36 having two diametrically opposed and longitudinally oriented rectangular protrusions 94 (see FIG. 11), curvilinear proximate container wall 37 and dispenser head 33. Dispenser head 33 is provided with notch 56, inclined nozzle 7 and closure cap 8, which normally covers nozzle 7, and is separated therefrom during the dispensing of toothpaste. Nozzle 7 is bent at an angle (about 45 degrees in this embodiment) to form an inclined, proximate portion and a straight distal portion (see e.g. FIGS. 8 and 9). Outer wall 36 is preferably tubular and contains toothpaste within paste or pumping chamber 6, defined by the region between the elastic means consisting in an annular plate 39 and a displaceable unit 15 (see FIG. 4).

Figure 4:
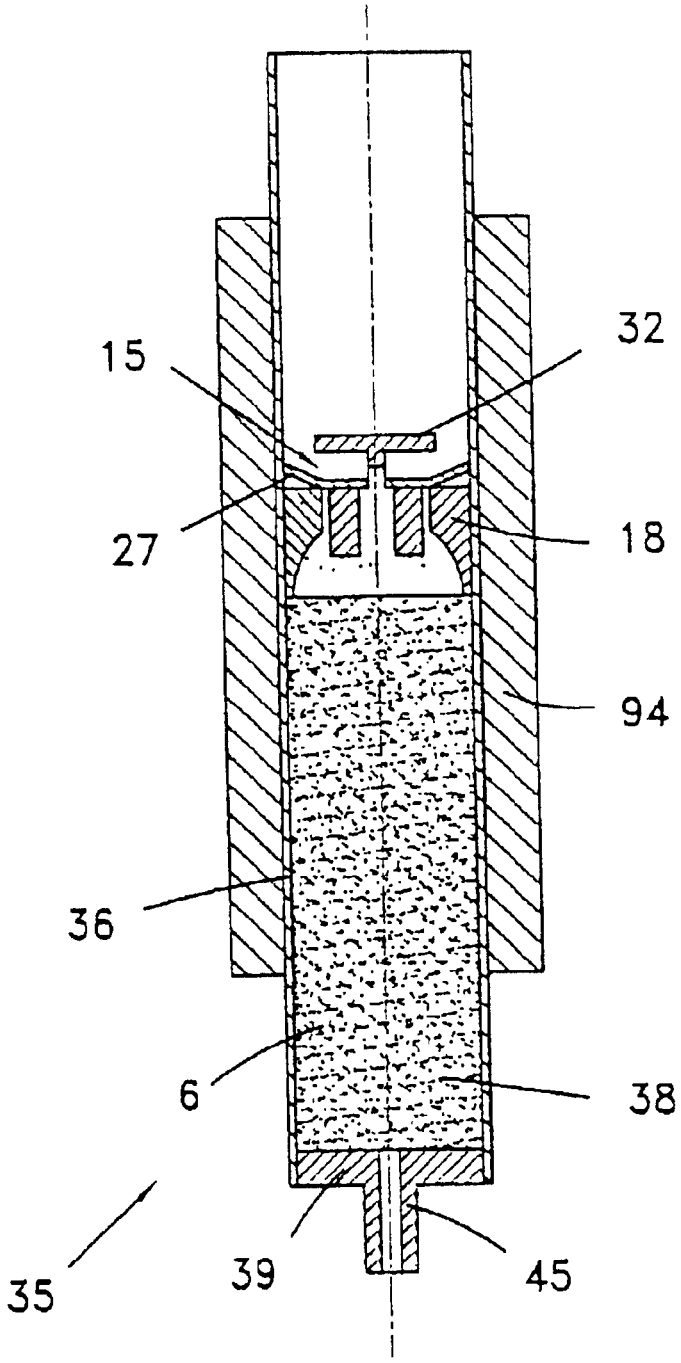
FIG. 4 is a partial longitudinal cross sectional view of the container of FIG. 3.

FIG. 4 is a partial longitudinal section of container 35. Paste 38 is contained within pumping or paste chamber 6, and is defined as the volume between displaceable unit 15, comprising piston 18, clamp module 27 and disc 32, and elastic means 39. Elastic means 39 is a resilient pressurizing means which is provided at its proximate end with an annular nozzle extension 45, through which paste 38 flows when element 39 exerts a pressure on the paste contained in the pumping chamber, said extension having an outer diameter significantly smaller than that of element 39. Element 39 is attached, e.g. by heat sealing or by cement, to a proximate portion of wall 36, so that it may be deformable in a distal direction, yet capable of returning to its base configuration. Housing 110 (FIG. 3) is a support means for holding container 36 in a predetermined position when a force is applied to elastic means 39.

Figure 5:
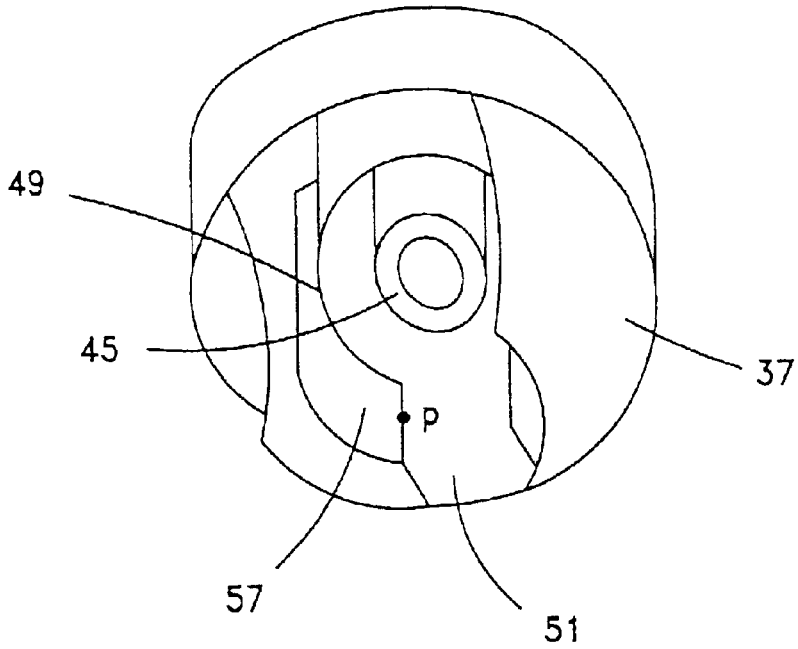
FIG. 5 is a perspective view of the proximate container wall of the container of FIG. 3.

As shown in FIG. 5, nozzle extension 45 is encircled by collar 49, which is integrally formed with proximate container wall 37, and is connected thereto by spacer 51 and by a planar member (not shown), which is substantially parallel to elastic means 39 (FIG. 4). Proximate container wall 37 is formed with a recess 57 on each side of spacer 51. A spring (not shown) is insertable between nozzle extension 45 and collar 49.

Figure 6A:
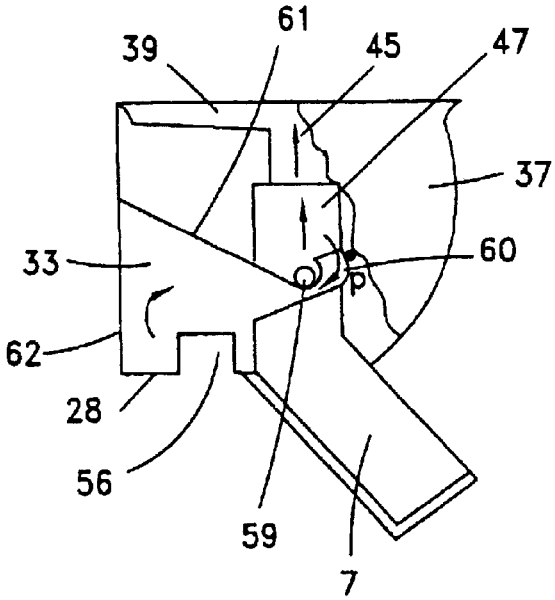
FIG. 6 is a schematic drawing, showing the displacement of the elastic means, in accordance with the container of FIG. 3.
Figure 6B:
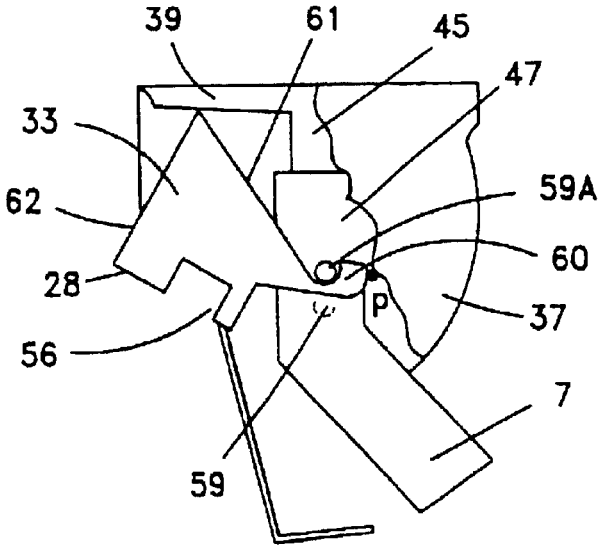

Referring now to FIGS. 6A and 6B, each side wall of dispenser head 33 is perpendicular to substantially flat surface 28, which is normally horizontally disposed. Each side wall is provided with an inclined distal border 61, extending from relatively long border 62 to relatively short side wall appendage 60. A seat is formed at the proximate end of border 61. Each appendage 60 is configured in such a way that it is insertable in a corresponding recess 57 (FIG. 5), whereby dispenser head 33 is firmly retained by opposite sides of proximate container wall 37, yet is allowed to pivot about pivot P within said recess.

The straight portion 47 of nozzle 7 is provided with a pair of pins 59, which are coaxial and laterally protrude from the outer wall of the nozzle. Each pin is retained by a seat formed in the corresponding side wall. As dispenser head 33 is inserted into proximate container wall 37, nozzle 7, which is seated in the dispenser head by means of pins 59, comes in contact with said nozzle extension 45 of elastic means 39. Upon upwardly (as seen in the drawings) depression of surface 28, dispenser head 33 is rotated in a clockwise direction. Accordingly, appendage 60 is also rotated in a clockwise direction, causing the wall of the seat to press and displace pins 59 longitudinally in a distal direction, viz. upwardly as seen in the drawings and as will occur in the normal use of the paste dispenser. Said displacement of pins 59 causes a distal displacement of nozzle extension 45 and therefore a deformation of elastic means 39 in a distal direction, thereby reducing the volume of pumping chamber 6 and causing the discharge of toothpaste. After release of dispenser head 33, elastic means 39 immediately returns to its base configuration. A helical spring (not shown) placed around nozzle portion 45 further assists dispenser head 33 and nozzle 7 to return to their inactive positions after the proper amount of toothpaste has been dispensed.

Figure 9:
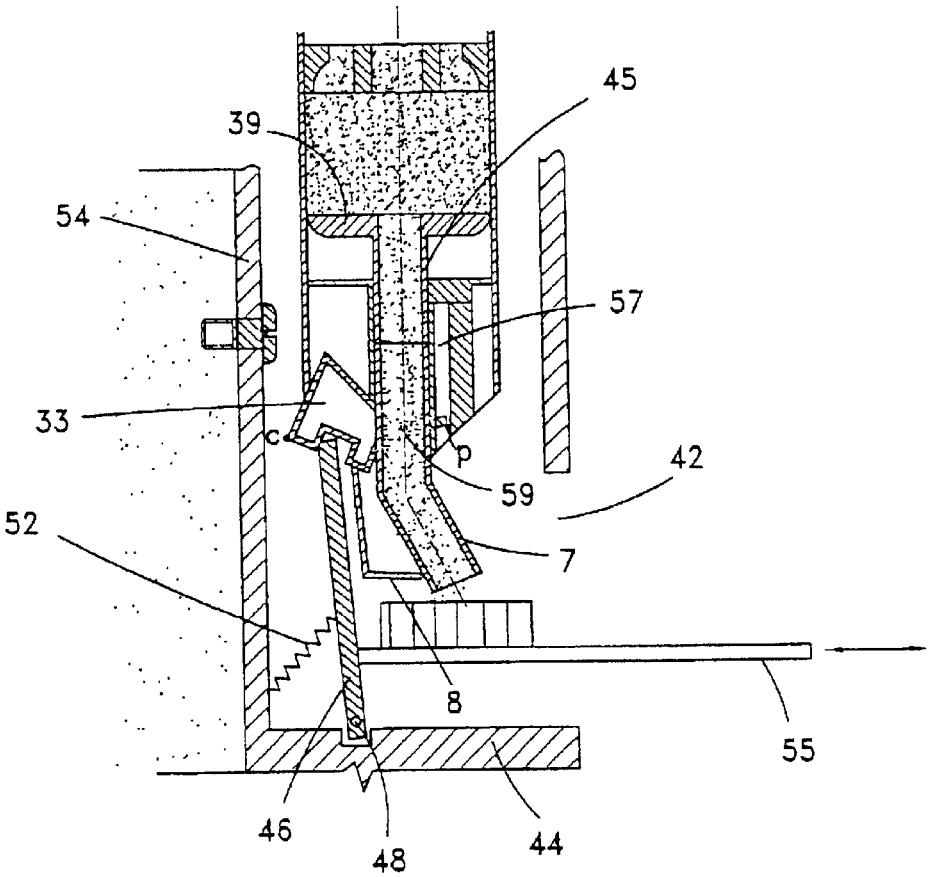
FIG. 9 is a cross-sectional view of the dispenser, cut along plane A—A of FIG. 7, showing the dispenser head being actuated in accordance with the present invention.

As elastic means 39 is displaced, the volume of pumping chamber 6 is diminished, causing toothpaste contained therein to be submitted to pressure. The pressurized toothpaste, the pressure of which is dependent on the degree of movement of means 39, then flows through nozzle 7 in metered fashion and is discharged onto a toothbrush. The dimensions of the various parts of the device are such that the discharged paste falls on the bristles of the toothbrush, as shown in FIG. 9. Following discharge of the toothpaste, a partial vacuum develops within pumping chamber 6. The pressure differential between the ambient pressure outside of the pumping chamber and the partial vacuum within said chamber acts on disc 32 (FIG. 4), which is part of the displaceable element 15, to incrementally displace said disc and said element in a proximate direction, until pumping chamber 6 attains the volume of the remaining amount of non-discharged toothpaste.

Figure 7:
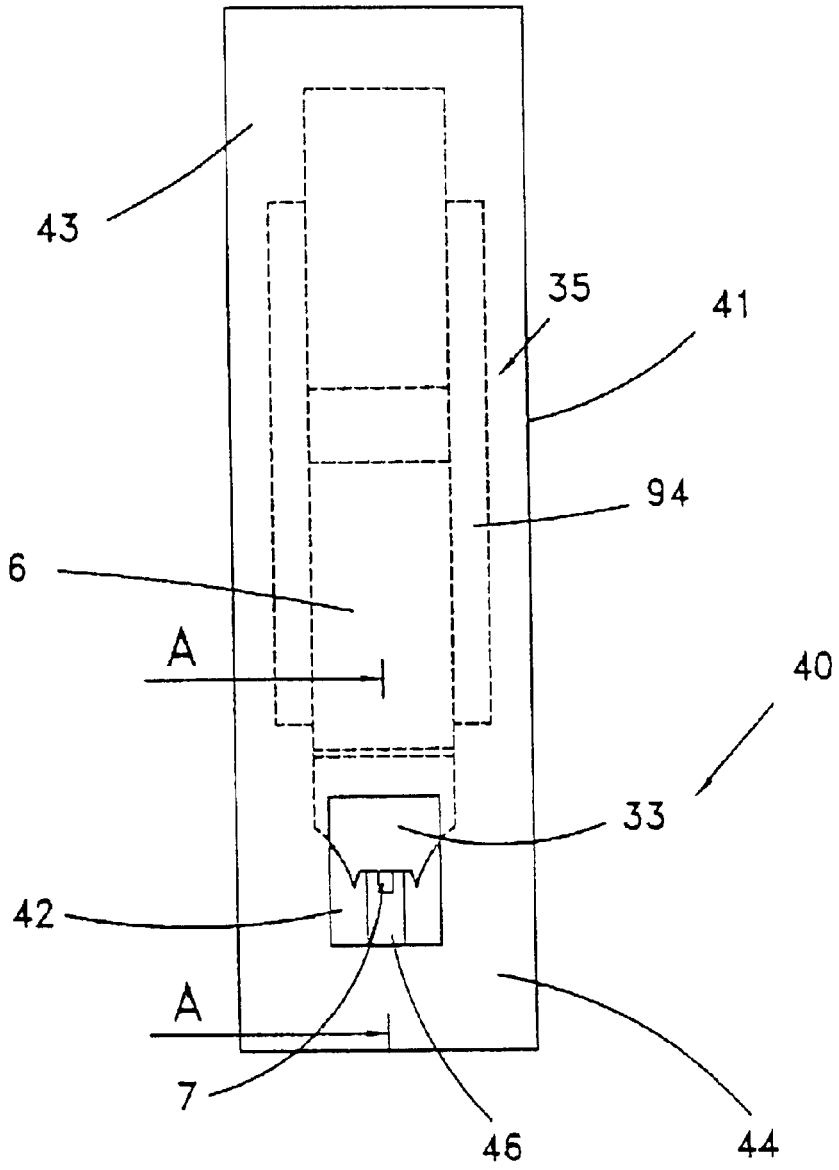
FIG. 7 is a front view of a toothpaste dispenser, in accordance with one preferred embodiment of the present invention.

As illustrated in FIG. 7, dispenser 40 is enclosed, in this embodiment, in housing 41, which may be affixed to a planar surface or conveniently mounted on a wall. Housing 41 has any convenient shape and has a hollow interior. It is formed with opening 42 between upper portion 43 and lower portion 44 thereof. Opening 42 has a sufficient width and height to accommodate the insertion of a toothbrush through it. Container 35 is fixedly or removably attachable in an upside-down position to the interior of housing 41, e.g. by means of longitudinal protrusions 94 or by threading, such that pumping chamber 6 of the container is located within upper portion 43 and dispenser head 33 is accessible through opening 42. Housing 41 has an air inlet (not shown), which assists in the displacement of displaceable unit 15 due to the pressure differential between the interior and exterior of pumping chamber 6, as described hereinbefore.

Figure 8:
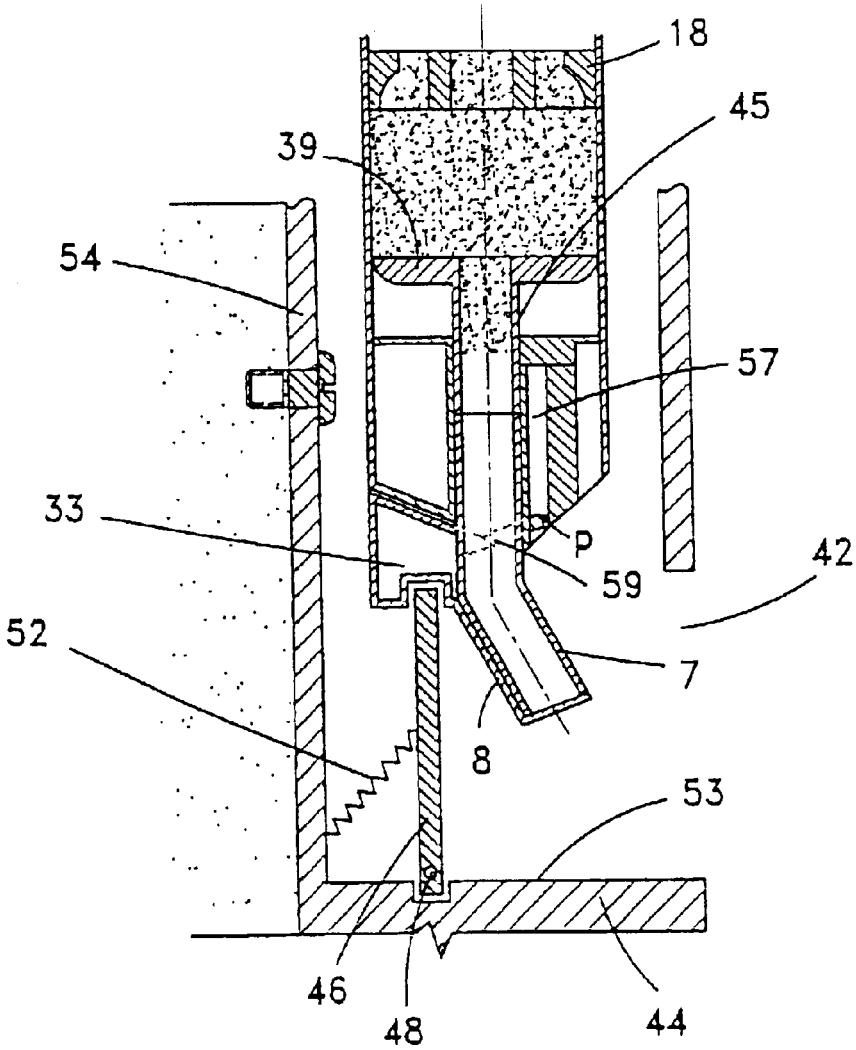
FIG. 8 is a cross-sectional view of the dispenser, cut along plane A—A of FIG. 7, showing the actuating member in a rest position.

Referring now to FIGS. 8 and 9, the dispenser is adapted to receive an actuating means. The actuating means is, for example, a rigid rectangular strip 46, e.g. metallic, which extends along the height of opening 42. Strip 46 is swingable about pin 48 placed within seats (not shown) formed in opposite sidewalls of lower portion 44 of the housing. Surface 28 is formed with slot 56 (FIG. 6) having a gap substantially equal to, or slightly larger than, the thickness of strip 46. The upper end of strip 46 is inserted within slot 56, thereby allowing the strip to engage the dispenser head.

Strip 46 is biased by compression spring 52, which is attached at one end to an intermediate point of said strip and at the other end to rear wall 54 of the housing. After toothbrush 55 is inserted within opening 42 and contacts strip 46, the strip swings in a counterclockwise direction, causing spring 52 to compress. Strip 46 then applies a force to the outward side of slot 56 (see FIGS. 6A and 6B) and causes dispenser head 33 to swing in a clockwise direction and to separate closure cap 8 from nozzle 7. The maximum swing of dispenser head 33 is defined by contact point C (FIG. 9) between dispenser head 33 and rear wall 54 of the housing. The swinging of dispenser head 33, which engages nozzle 7 by means of pins 59 (FIGS. 6A and 6B), produces a force applied to nozzle 7 in the distal direction. Nozzle 7 in turn presses against and displaces nozzle portion 45, as well as elastic means 39 integrally formed therewith, into the pumping chamber. Toothpaste can therefore be dispensed through nozzle 7 onto toothbrush 55. Upon retraction of toothbrush 55, strip 46, dispenser head 33, nozzle 7 and nozzle portion 45 return to their rest positions.

Said strip 46 with spring 52 constitutes, in this embodiment, the actuating member. The distal portion of nozzle 7 constitutes, in this embodiment, the means for applying a force to the elastic means to deform said means. The dispenser head 33 and pins 59 constitute, in this embodiment, the means for kinematically connecting said actuating member to said means for applying a force to said elastic means.

Preferably, the width of strip 46 is significantly larger than that of dispenser head 33, so as to increase the contact area of the strip and to simplify the actuation of the dispenser by means of a toothbrush. A wider strip also reduces the possibility that strip 46 be dislodged from slot 56 during intermittent pivoting of dispenser head 33, which may cause the strip to slide in a lateral direction. There is also a chance that strip 46 may slide if toothbrush 55 is introduces into opening 42 at an angle to the strip. To further prevent the dislodging of the strip, the upper lateral ends of strip 46 may be provided with a protrusion (not shown) perpendicular to the upper edge of the strip. A stopper may be added (not shown) to limit the inward travel of dispenser head 33 during pivoting, to further prevent the dislodging of strip 46 from slot 56.

FIGS. 10–13 illustrate another preferred embodiment of a dispenser, designated by numeral 70, according to the present invention wherein an elongated dispenser head with a curvilinear cross section can be swung by engagement of a toothbrush with a seat formed therein.

Figure 10:
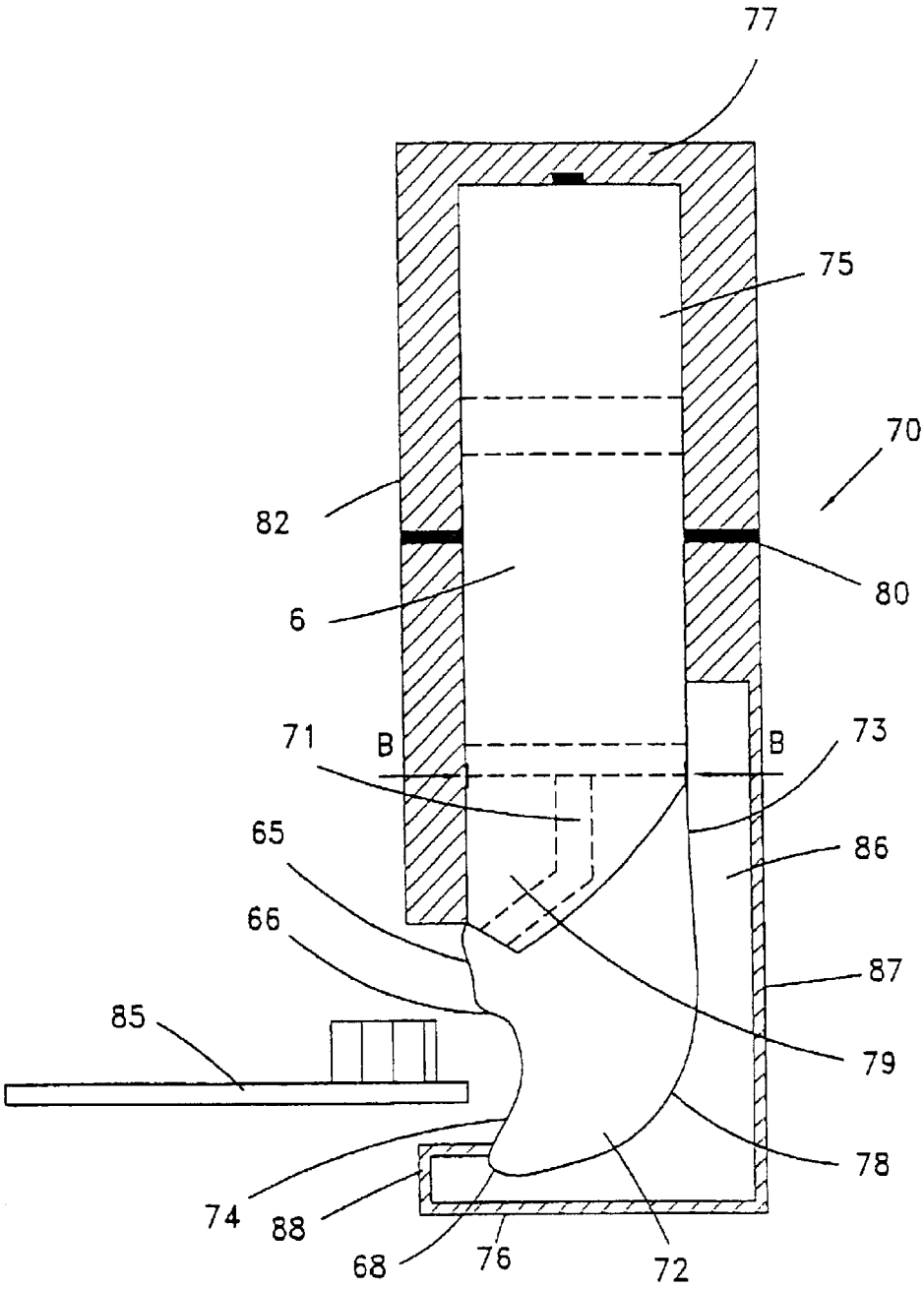
FIG. 10 is a longitudinal cross-sectional view of another preferred embodiment of a dispenser according to the present invention.

As shown in FIG. 10, container 75 is positioned in an upside-down position within housing 77. Container 75 is tubular and is provided with proximate container wall 79, which is that portion of the container wall that is proximate to pumping chamber 6. The container may be removable from the housing, but in this embodiment is permanently affixed to the housing by affixing means 80, e.g. cement. Front face 82 of the housing is provided with an opening, which allows for the insertion of toothbrush 85 through it. A recess 86 is formed in the volume between extension 88, housing bottom 76, rear face 87 and dispenser head 72, and allows the latter to swing in a counterclockwise direction without contacting rear face 87.

Dispenser head 72 has a rear portion 73 that is substantially straight and normally vertically disposed. Said rear portion terminates in curved segment 78, which is convex and curves until arcuate seat bottom 68. Top portion 65 of the dispenser head is substantially vertical and extends to seat top 66. Concave seat 74 is formed between seat top 66 and the seat bottom 68 and is capable of receiving toothbrush 85. The shape of seat 74 is compatible with that of toothbrush 85, such that an inward movement of toothbrush 85 into seat 74 causes dispenser head 72 to swing in a counterclockwise direction, thereby pressurizing toothpaste contained within container 75 and resulting in toothpaste to be dispensed from nozzle 71 onto the toothbrush. Upon removal of toothbrush 85 from seat 74, dispenser head 72 swings in a clockwise position to its rest position. The outward swing of dispenser head 72 is limited by extension 88, which is perpendicular to the lower portion of front face 82.

Figure 11:
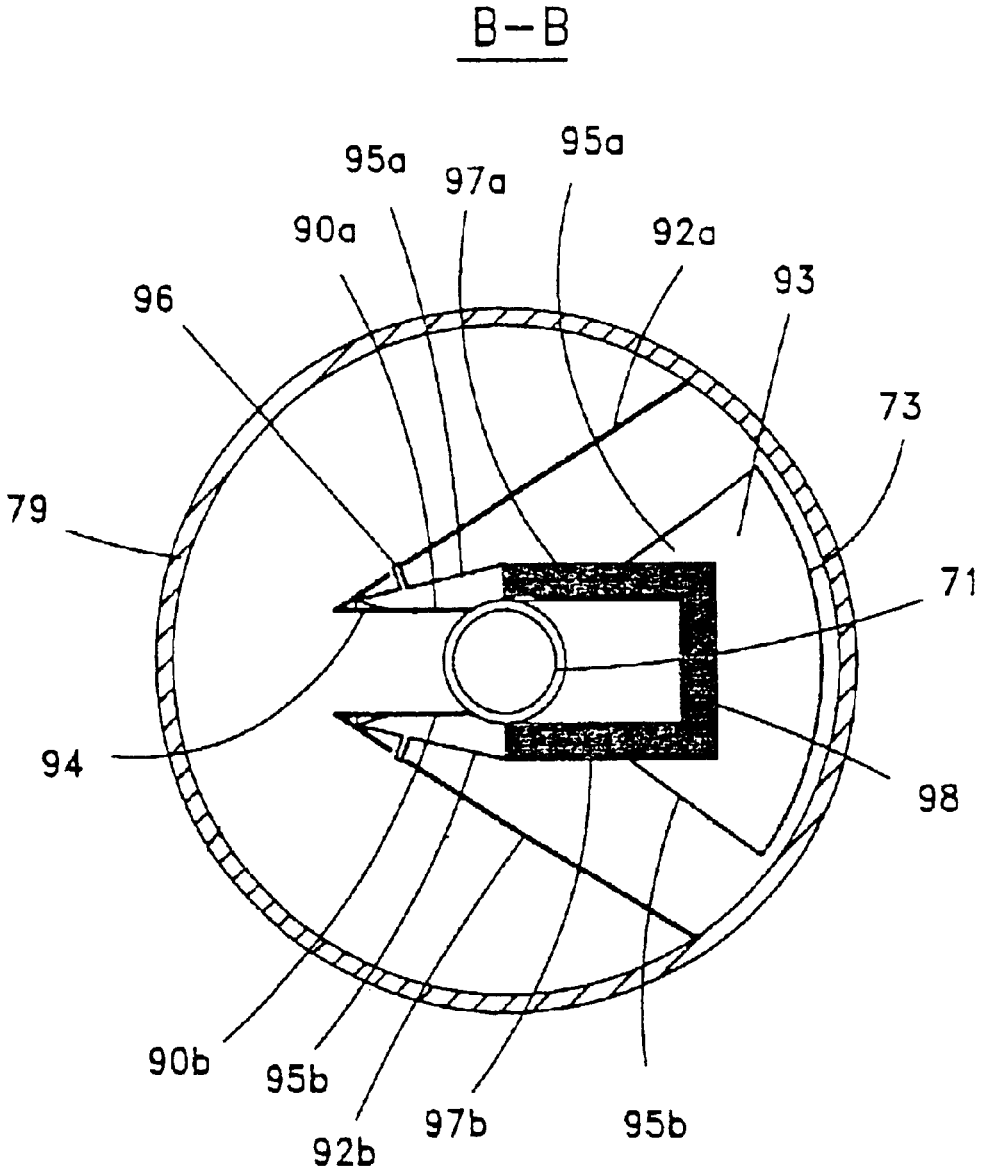
FIG. 11 is a cross-sectional view of the proximate container wall, cut along plane B—B of FIG. 10, showing the distal end of a dispenser head.
Figure 13:
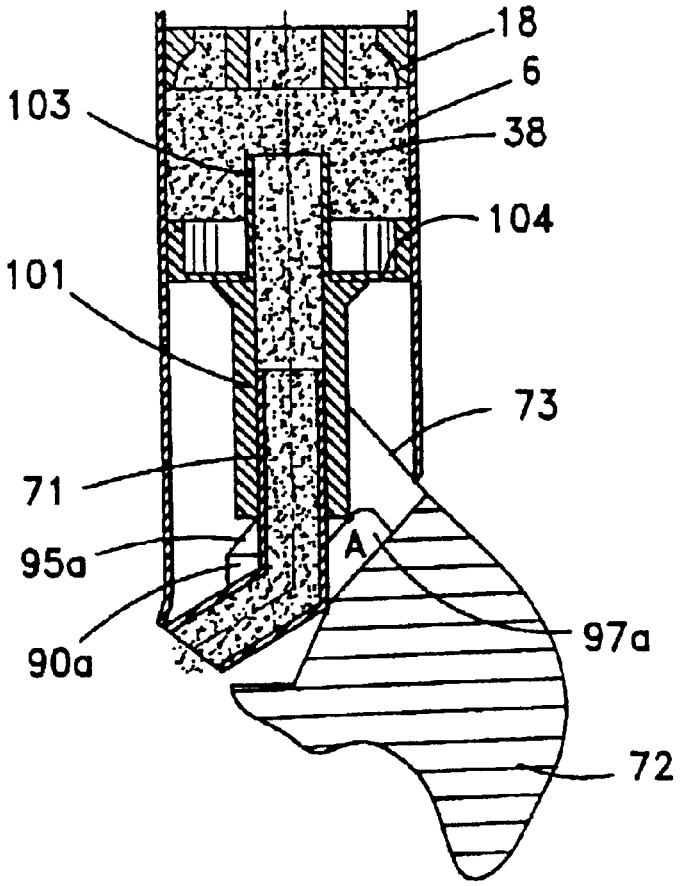
FIG. 13 is a partial longitudinal cross sectional view of a container, in accordance with the embodiment of FIG. 10, showing the elastic means in a displaced position.

FIG. 11 illustrates a lateral sectional view of proximate container wall 79, showing the distal end of the dispenser head. Nozzle 71, which has a distal straight portion and a proximate inclined portion, as shown in FIG. 13, is integrally formed with proximate container wall 79. Proximate container wall 79 is also formed with parallel support plates 90*a* and 90*b*, which outwardly extend from nozzle 71, in a direction opposite to rear portion 73 of the dispenser head, and are perpendicular to, nozzle 71. Proximate container wall 79 is also formed with inclined support plates 92*a* and 92*b*, which are arranged such that the contact surfaces of support plates 90*a*, 90*b*, 92*a* and 92*b* are coplanar. Inclined support plates 92*a* and 92*b* are provided with a corresponding opening for the seating therein of the dispenser head. Each parallel support plate is provided with a wedge-shaped protrusion 94, which laterally protrudes therefrom, towards the corresponding inclined support plate.

The distal end associated with rear portion 73 of the dispenser head is curved with respect with the illustrated lateral cross-section. Sidewalls 95*a* and 95*b* are integrally formed with, and substantially perpendicular to, rear portion 73, wherein each sidewall is seated in a corresponding inclined support plate by peg 96. Each sidewall longitudinally extends in a distal direction from base 93, which defines the boundary between solid dispenser head 72 and between the sidewalls, as clearly seen in FIG. 12, and which may not necessarily have an entirely lateral disposition with respect to the sidewalls. Parallel abutment plates 97*a* and 97*b*, which are connected to each other by spacer 98, longitudinally extend from base 93. The distal vertically disposed member of nozzle 71, which is integrally formed with proximate container wall 79, is interposed between each abutment plate.

Figure 12:
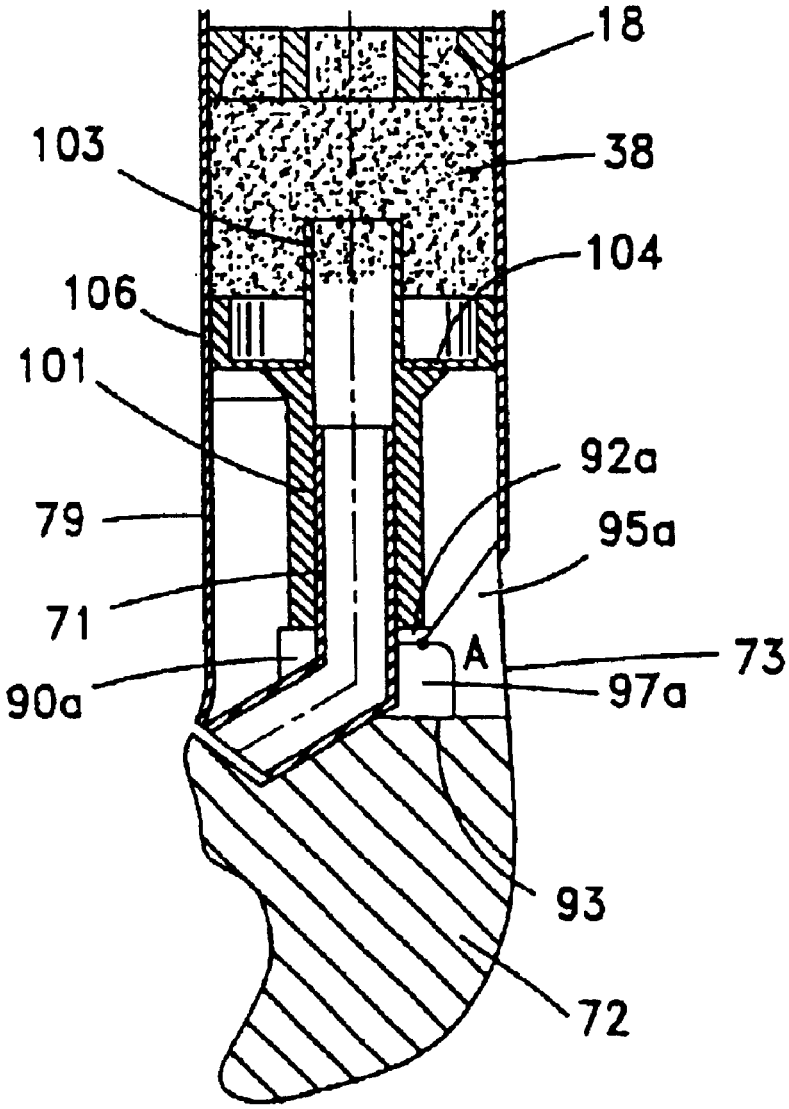
FIG. 12 is a partial longitudinal cross sectional view of a container, in accordance with the embodiment of FIG. 10, showing the elastic means in a rest position.

FIG. 12 illustrates the pressurizing means associated with this embodiment. The pressurizing means is provided with a proximate annular nozzle extension 101, a distal annular conduit 103, and flexible membrane 104 positioned between, and perpendicular to, the longitudinal axes of nozzle extension 101 and conduit 103. Nozzle extension 101 is concentric to, and mates with nozzle 71, and is integrally formed with flexible membrane 104, which is provided with a peripheral protrusion 106 having a diameter substantially equal to that of the inner wall of proximate container wall 79. Nozzle extension 101 is supported by parallel support plates 90*a* and 90*b*, as well as by inclined support plates 92*a* and 92*b*.

As shown in FIG. 13, upon actuation of dispenser head 72, wherein the latter swings in a counterclockwise direction as described hereinabove, abutment plates 97*a* and 97*b* pivot in a similar direction and abut the wall of nozzle extension 101 at abutment point A, which is disposed outward with the respect to the wall of the vertical nozzle member. As the abutment plates contact the nozzle extension, membrane 104 is flexed, causing nozzle extension 101 and conduit 103 to be distally displaced, thereby reducing the volume of pumping chamber 6 and facilitating the discharge of toothpaste 38 through conduit 103, nozzle extension 101 and nozzle 71. Due to the springiness of membrane 104, nozzle extension 101 returns to its rest position upon release of the toothpaste from dispenser head 72, and abutment plates 97*a* and 97*b* are consequently caused to be lowered.

The dispenser may be provided without an opening in its front face, such that dispenser head 72 protrudes from container bottom 106 (FIG. 15). Rear face 87 (FIG. 11) and side walls of the housing (not shown) may be longer than front face 82, to provide added protection to dispenser head 72.

Said dispenser head 72 constitutes, in this embodiment, the actuating member. Annular nozzle extension 101 constitutes, in this embodiment, the means for applying a force to the elastic means to deform said means. Abutment plates 97*a* and 97*b* and rear portion 73 of the dispenser head constitute, in this embodiment, the means for kinematically connecting said actuating member to said means for applying a force to said elastic means.

Figure 14:
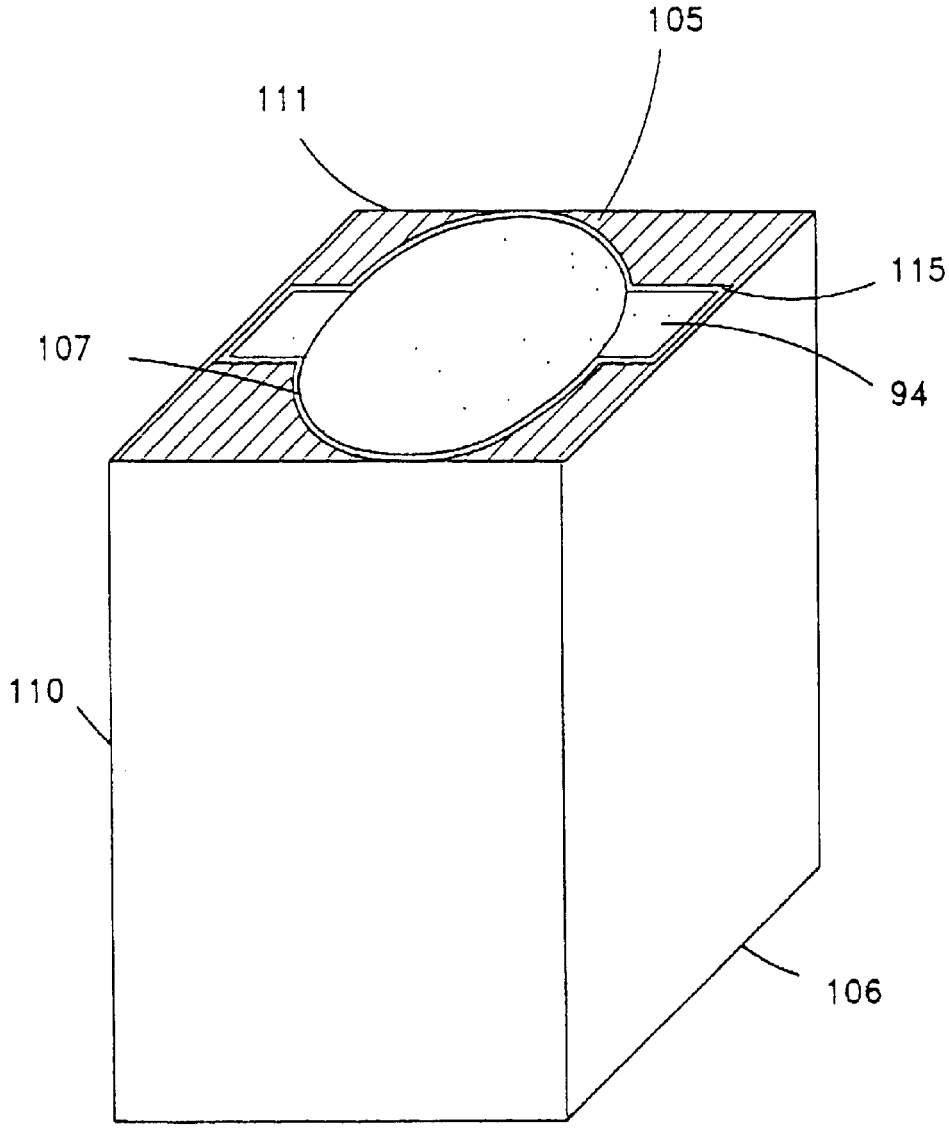
FIG. 14 is a perspective view of the rear and top of a dispenser in accordance with the present invention, showing a means by which a container is releasably attached to the housing.

FIG. 14 illustrates a means for releasably attaching container 105 to housing 110. Top face 111, which is representative of a cross sectional cut of the housing, has a solid outer zone and an interior opening adapted to receive container 105. The interior opening is comprised of a circular central aperture 107, which has an inner diameter slightly larger than the outer diameter of container 105, and a pair of rectangular tracks 115, diametrically opposed one to another. Container 105 is attachable to housing 110 by means of longitudinal rectangular protrusions 94 formed on the outer wall of container 105, each of which is insertable within a corresponding similarly shaped track 115.

Figure 15B:
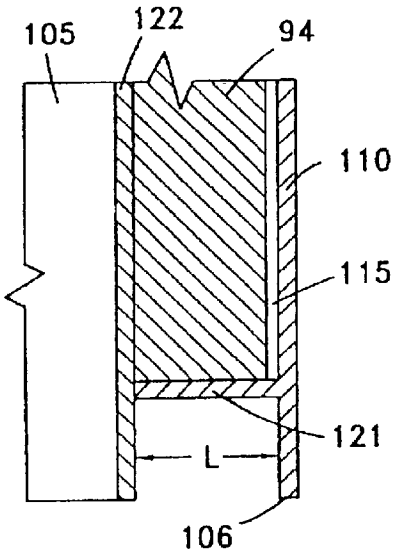
FIGS. 15*a* to 15*c* are, respectively, a side view of a container having an enlarged top end, a longitudinal cross-sectional view of an inwardly extending step disposed at the bottom of a track, and a longitudinal :cross-sectional view of the top of a container illustrating a recess formed outwardly with respect to the container.
Figure 15A:
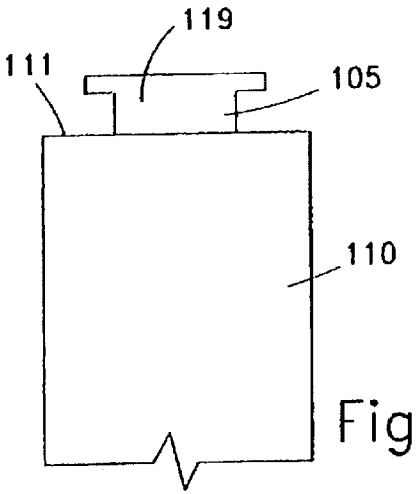

FIG. 15 depicts different alternatives for limiting a downward movement of container 105. As shown in FIG. 15*a*, container 105 is provided with a top distal end 119 with a larger diameter than aperture 107 (FIG. 14) of housing 110 into which the container can be inserted. Further downward displacement of container 105 is prevented when top end 119 abuts top face 111 of the housing.

In FIG. 15*b*, a downward movement of container 105 is limited by inwardly extending step 121. Step 121 is essentially perpendicular to the outer wall of housing 110 and is added to the bottom of a corresponding track 115, at a predetermined height above housing bottom 106. Length L of step 121 is essentially equal to the width of protrusion 94, which laterally projects from container wall 122, to allow for maximum contact between the step and the protrusion on one hand, yet allowing the bottom of container 105 to descend at least to housing bottom 106 without interference with the inward edge of step 121. Step 121 preferably has a width greater than the thickness of a corresponding protrusion 94 (not shown) so as to further maximize contact between the step and protrusion and to compensate for slippage. In this configuration, the top end of container 105, which is not necessarily larger than aperture 107 (FIG. 14), protrudes from the top face (not shown) of housing 110 at the rest position of the container within the housing, thereby facilitating removal of the container from housing 110.

Figure 15C:
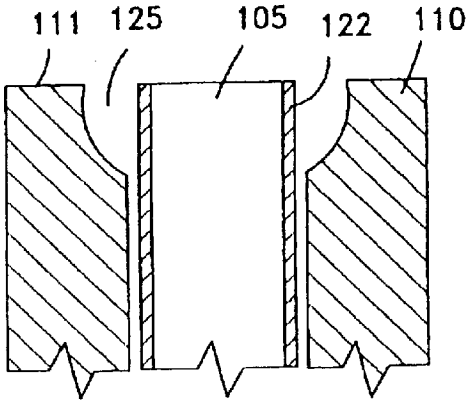

FIG. 15*c* illustrates a way of easily removing container 105 from housing 110, even though the top of the container is coplanar with top face 111 of the housing at the rest position of container 105 within the housing, e.g. step 121 is proximate to housing bottom 106. Top face 111 of the housing is formed with recess 125 outwardly spaced from outer wall 122 of the container. Recess 125 preferably slopes downward from top face 111 to a lower location adjacent to outer wall 122 of the container. By means of recess 105, the top end of the container is therefore accessible and capable of being removed from the housing.

With employment of the present invention, the dispensing of toothpaste is a less awkward procedure. Only one hand is needed to apply toothpaste since the toothbrush itself initiates actuation of the dispenser head of the toothpaste container, and consequently even a handicapped person who has use of only hand can independently brush his own teeth.

It will be appreciated that the housing, container, displaceable unit, elastic means, actuating means and longitudinal protrusions of the container may have any other suitable size, shape, orientation or configuration that enables the one-hand dispensing of toothpaste onto a toothbrush in metered fashion with a minimal number of moving parts, whereby the remaining toothpaste is prevented from drying. Likewise, the apparatus of the present invention may be employed for the one-hand dispensing therefrom of any other desired paste, such as glue and mustard.

while some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

What is claimed is:

1. An improved dispenser for pastes comprising:

a) a paste container having a wall, b) an elastic means having a base configuration, being deformable by application of a force thereto and elastically returning to said base configuration when said application of a force is discontinued, c) a displaceable element, d) said wall, elastic means and displaceable element defining a variable volume paste chamber, e) a dispenser nozzle communicating with said chamber for dispensing paste therefrom, f) said displaceable element being displaced by room pressure, as a result of a reduced pressure in said paste chamber, towards said elastic means upon the return of said elastic means to said base configuration, g) an actuating member, accessible from outside the container and displaceable from an inactive to an active position, and h) means for applying a force to said elastic means to deform said elastic means, in such a way as to reduce the volume of said chamber, thereby causing said paste to be dispensed through said dispenser nozzle, when said actuating member is displaced from the inactive to the active position, and i) a kinematism for kinematically connecting said actuating member to said means for applying a force to said elastic means to deform said elastic means, when said actuating means is displaced to its active position, and for allowing said elastic means elastically to return to said base configuration thereof when said actuating means is returned to its inactive position.

2. Dispenser according to claim 1, wherein the wall of the paste container is tubular and the elastic means and the displaceable element are located at its opposite ends.

3. Dispenser according to claim 1, wherein the actuating means comprise a swinging member that can be manually swung from the inactive to the active position by applying a force to it.

4. Dispenser according to claim 3, wherein the swinging member can be swung by applying a force to it through a toothbrush.

5. Dispenser according to claim 3, wherein the swinging member is provided with spring means to return it to the inactive position when the force is no longer applied to it.

6. Dispenser according to claim 1, wherein the dispenser nozzle is operatively connected to the actuating means and to the elastic means and is a part of the said kinematism, whereby it is displaced to its operative position concurrently with the application of a force to said elastic means.

7. An improved dispenser for pastes comprising:

a) a paste container having a wall, b) an elastic means having a base configuration, being deformable by application of a force thereto and elastically returning to said base configuration when said application of a force is discontinued, c) a displaceable element, d) said wall, elastic means and displaceable element defining a variable volume paste chamber, e) a dispenser nozzle normally in an inoperative position in which it does not communicate with said chamber, f) said displaceable element being displaced by room pressure, as a result of a reduced pressure in said paste chamber, towards said elastic means upon the return of said elastic means to said base configuration, g) an actuating member, accessible from outside the container and displaceable from an inactive to an active position, and h) means for applying a force to said elastic means to deform said elastic means, in such a way as to reduce the volume of said chamber, thereby causing said paste to be dispensed through said dispenser nozzle, when said actuating member is displaced from the inactive to the active position, and i) a kinematism for kinematically connecting said actuating member to said means for applying a force to said elastic means to deform said elastic means, when said actuating means is displaced to its active position, and for allowing said elastic means elastically to return to said base configuration thereof when said actuating means is returned to its inactive position, wherein the dispenser nozzle is displaceable, upon actuation of the actuating means, to an operative position in which it communicates with the paste chamber to allow dispensation of the paste therefrom.

8. An improved dispenser for pastes comprising:

a) a paste container having a wall, b) an elastic means having a base configuration, being deformable by application of a force thereto and elastically returning to said base configuration when said application of a force is discontinued, c) a displaceable element, d) said wall, elastic means and displaceable element defining a variable volume paste chamber, e) a dispenser nozzle communicating with said chamber for dispensing paste therefrom, f) said displaceable element being displaced by room pressure, as a result of a reduced pressure in said paste chamber, towards said elastic means upon the return of said elastic means to said base configuration, g) an actuating member, accessible from outside the container and displaceable from an inactive to an active position, h) means for applying a force to said elastic means to deform said elastic means, in such a way as to reduce the volume of said chamber, thereby causing said paste to be dispensed through said dispenser nozzle, when said actuating member is displaced from the inactive to the active position, i) a kinematism for kinematically connecting said actuating member to said means for applying a force to said elastic means to deform said elastic means, when said actuating means is displaced to its active position, and for allowing said elastic means elastically to return to said base configuration thereof when said actuating means is returned to its inactive position, and j) a support means for holding the paste container in a predetermined position when said force is applied to said elastic means.

9. Dispenser according to claim 8, wherein the support means is a housing for receiving and supporting the paste container in predetermined positioned relationship.

10. Dispenser according to claim 9, wherein the housing is rigid and fixed, each paste dispenser being engageable with said housing and accessible therethrough as far as necessary for the actuating means to be operated and for the paste to be received from the dispensing nozzle.

11. Dispenser according to claim 9, wherein the housing is provided with an opening through which the actuating means is accessible.

12. Dispenser according to claim 9, wherein the displaceable element is a piston.

13. Dispenser according to claim 11, wherein the actuating member is a rigid strip which is accessible through the opening, said strip being swingable about pins seated in said housing.

14. Dispenser according to claim 11, further comprising a dispenser head at the proximate end of the container formed with a slot having a gap substantially equal to, or slightly larger than, the thickness of the strip, the upper end of the strip being insertable within the slot, the strip being inwardly swingable upon contact with an elongated member, whereby to actuate the dispenser head.

15. Dispenser according to claim 14, wherein the width of the strip is larger than that of dispenser head.

16. Dispenser according to claim 14, wherein upper lateral ends of the strip are provided with a protrusion perpendicular to the upper edge of the strip, thereby preventing the strip from being dislodged from the dispenser head.

17. Dispenser according to claim 13, wherein the housing further comprises a stopper to thereby limit the inward travel of the dispenser head during swinging.

18. Dispenser according to claim 10, wherein the actuating member is a dispenser head at the proximate end of the container provided with a protrusion having a curvilinear cross section and a seat formed in said protrusion, said seat being accessible through the opening and capable of receiving the elongated member, the elastic means capable of being distally displaced by means of the dispenser head, a distal movement of the dispenser head being initiated by an inward movement of an elongated member into said seat.

19. Dispenser of claim 8, comprising a spring for biasing the actuating member.

20. Dispenser of claim 8, wherein the displaceable unit is displaceable in a proximate direction and is provided with means for preventing displacement in a distal direction.

21. Dispenser of claim 8, wherein the elastic means is a resilient annular body connected at its proximate end with a distal portion of the nozzle.

22. Dispenser of claim 9, wherein the container is releasably attachable to the housing.

23. Dispenser of claim 9, wherein the container is attachable to the housing by means of protrusions formed on the outer wall of the container, said protrusions being insertable within similarly shaped tracks formed within the housing.

24. Dispenser of claim 21, wherein a downward movement of the container is limited by a top end of the container, the maximum lateral dimension of said top end of the container being larger than the maximum lateral dimension of the wall of the container.

25. Dispenser of claim 23, wherein a downward movement of the container is limited by a step inwardly extending from the housing, said step being added to the bottom of each track.

26. Dispenser of claim 25, wherein the length of the step may be essentially equal to the width of a corresponding protrusion and the width of the step may be slightly greater than the thickness of a corresponding protrusion.

27. Dispenser of claim 25, wherein the step is disposed at a predetermined height above the bottom of the housing.

28. Dispenser of claim 22, wherein a rest position of the container within the housing is such that a top of the container is coplanar with a top face of the housing, said top face of the housing being formed with a recess outwardly spaced from the outer wall of the container, a top end of the container being accessible by means of said recess, the container thereby being removable from the housing upon the raising of the top end.

29. Dispenser of claim 9, wherein the housing is provided with an air inlet, the displaceable element being displaceable in a proximate direction due to a pressure differential between the interior and exterior of the pumping chamber of the dispenser, the pumping chamber achieving a partial vacuum upon return of the elastic means to the base configuration.

30. Dispenser of claim 8, wherein the paste is toothpaste, the dispenser being capable of dispensing a metered amount of toothpaste onto a toothbrush.

31. Dispenser of claim 30, wherein the dispenser is capable of applying toothpaste to the toothbrush with the use of only one hand.

* * * * *